US006732880B1

(12) United States Patent
Nash, Sr.

(10) Patent No.: US 6,732,880 B1
(45) Date of Patent: May 11, 2004

(54) NASH TRASH CAN 2(NTC2)/TRASH AND STORAGE RECEPTACLE

(76) Inventor: Franklin Delano Nash, Sr., 1502 Milestone Dr., Silver Spring, MD (US) 20904

( * ) Notice: Subject to any disclaimer, the term of this patent is extended or adjusted under 35 U.S.C. 154(b) by 0 days.

(21) Appl. No.: 10/255,683

(22) Filed: Sep. 27, 2002

(51) Int. Cl.[7] ..... B65D 90/04

(52) U.S. Cl. ..... 220/495.06; 220/495.11; 220/4.22; 220/508.1; 220/909

(58) Field of Search ..... 220/4.22, 4.23, 220/908.1, 908, 485.06, 495.1, 495.06, 909

(56) References Cited

U.S. PATENT DOCUMENTS 1,157,008 A * 10/1915 Lang ..... 220/6
2,624,451 A * 1/1953 Ewing ..... 206/541
2,859,891 A * 11/1958 Carkin ..... 215/11
3,063,591 A * 11/1962 Laginestra ..... 220/4.22
3,136,398 A * 6/1964 Platt ..... 206/315.9
4,763,809 A * 8/1988 Miller et al. ..... 220/407
4,867,328 A * 9/1989 McCarthy ..... 220/177
4,905,853 A * 3/1990 Strawder ..... 220/17
4,923,080 A * 5/1990 Lounsbury ..... 220/600
4,955,497 A * 9/1990 Winden et al. ..... 220/408
5,005,727 A * 4/1991 Roth ..... 220/404
5,558,246 A * 9/1996 Ross, Jr. ..... 220/737
5,878,904 A * 3/1999 Schweigert ..... 220/23.88
5,901,872 A * 5/1999 Zollinhofer et al. ..... 220/573
6,234,339 B1 * 5/2001 Thomas ..... 220/495.07
6,283,321 B1 * 9/2001 Meshorer ..... 220/495.07
6,311,859 B1 * 11/2001 Haas ..... 220/4.22

* cited by examiner

*Primary Examiner*—Joseph M. Moy

(57) ABSTRACT

The present invention is an improved hinged receptacle or container which allows quick, safe and convenient dislodging, removal or ejection of contents of any shape or size, lined or unlined with plural uses having a hollow body member and an interior horizontal base bottom floor, which is halved and is attached to it's vertical side(s). It has a pivotal piano type hinged side, with the opposite side(s) or it's vertical side having a locking closure fastener system on it's side wall(s), and opposite the said horizontal halved base bottom floor an opening with a top of any type for closure and sealing in it's contents in normal operational uses and purposes. The opening side allows and provides for a quick, safe and very convenient method to have it's stored or discarded contents dislodged and or ejected in a manner which requires known minimum effort by it's user or commercial handler with a wiggle motion, minor movement by user or by opening it's bottom and wall halves to between 0 degree to or greater than 180 degrees, therefore allowing it's contents to automatically become ejected and or dislodged, because at those degrees the receptacle or container becomes bottomless, thus allowing it to have it's contents dislodged or ejected at the user's desired location; for example a receptacle or container of yard debris and or a user's contents which are heavy such as books or one's gadgets, as well as a user's discarded rubbish in which a sanitation employee needs to removed, maybe dislodged or ejected at desired location easily, automatically and near effortless regardless of receptacle or container geometric shape.

9 Claims, 6 Drawing Sheets

Figure 2:
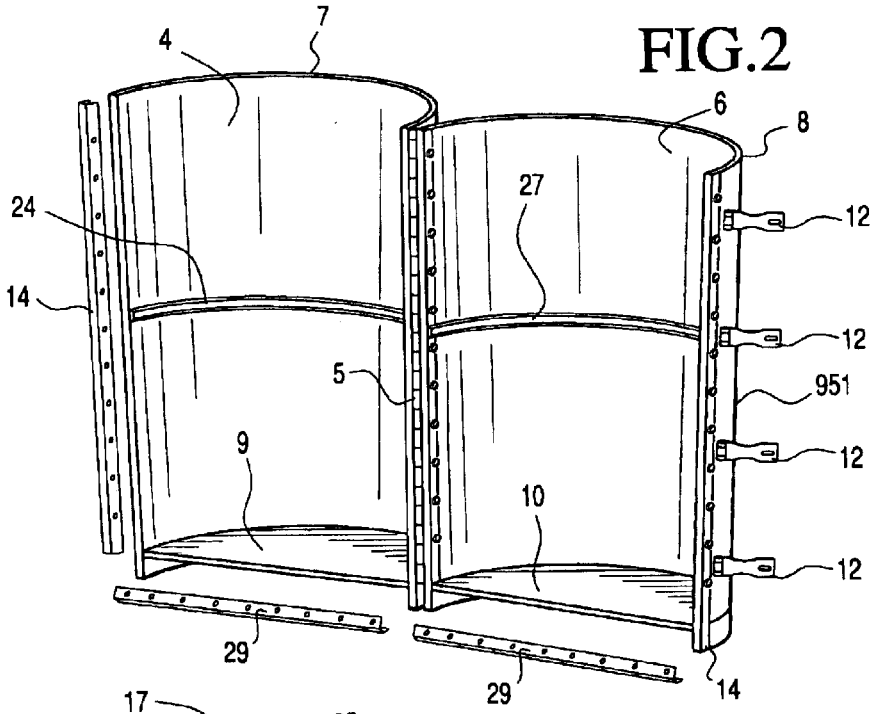

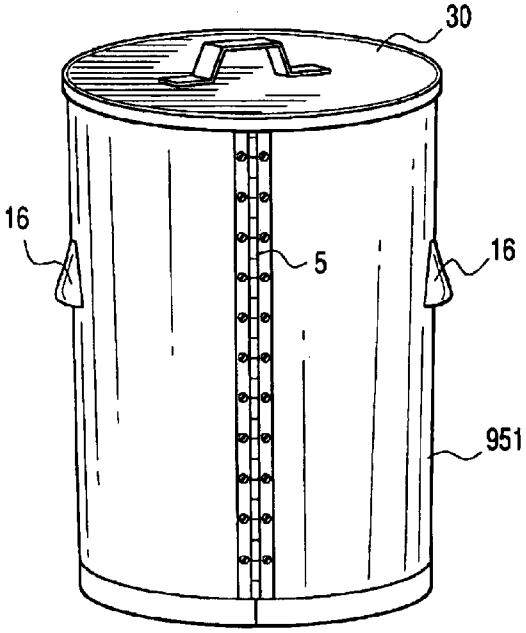
FIG.1
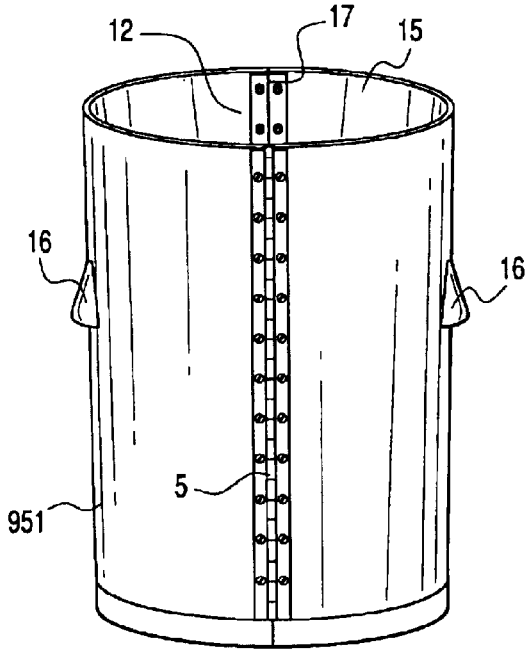
FIG.1A
FIG.1B
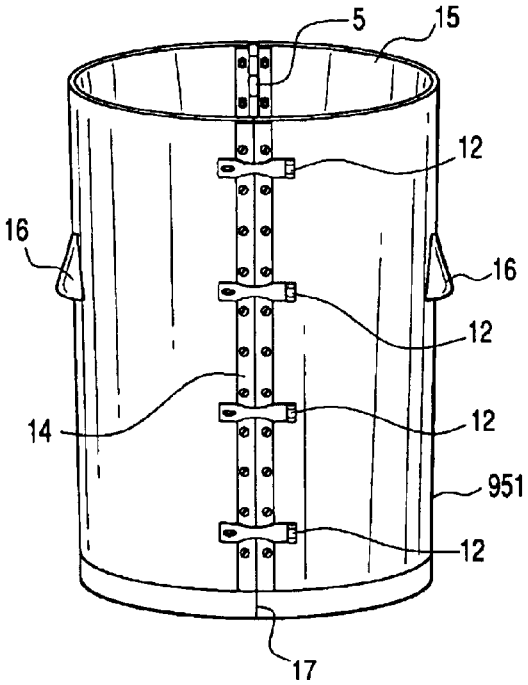
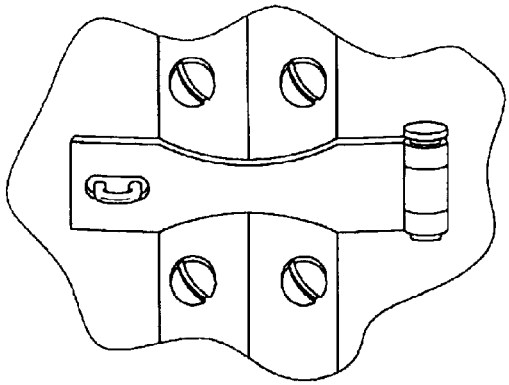
FIG.1C

NASH TRASH CAN 2(NTC2)/TRASH AND STORAGE RECEPTACLE

BACKGROUND OF INVENTION

1. Field of the Invention

The present invention relates to a hinged receptacle or container and more specifically pertains to a new and improved hinged receptacle or container for users for storage, discarded contents or rubbish in reference to the removal of it's contents, whether lined or unlined (with a type of known insert or bag), without requiring necessarily any vertical lifting or horizontal sliding when the receptacle or container itself, lined or unlined is opened and operated to between 0 degree to 180 degrees or greater, to achieve it's maximum functionally and open operational position. When maximum functional position is achieved, contents will automatically be dislodged or ejected because at that point the receptacle or container becomes bottomless at prior center point. With people living longer and or having more medical problems, there is a great need for an easier, less stressful, injury reducing method to remove filled lined or unlined contents for them. Therefore, the present invention is and has the method to reduce what is considered to be a problem, that being the suction factor and or the friction factor that exist inside of filled receptacles or containers at the time of removal by people, of it's contents when lined or unlined, especially if it's contents has been forced packed in it's hollow members. The present invention halved/sectional base bottom floor may/may not have wheeled mechanism(s). The present invention does eliminate the suction factor and the friction factor that exist and reduces or eliminates ankle, leg, foot or toe injury possibilities that may occur when liner bags are used and attempted to be removed and the vacuum pressure created between liner bag and the receptacle or container is released in an immediate downward motion across toes, feet or ankles, thus leading to potential lose of toes from such action or other injuries.

2. Description of Prior Art

Various types of receptacles or container are known in prior art. Such examples of receptacles and containers are discussed below. The U.S. Pat. No. 3,063,591, which is issued to N. Laginestra on Nov. 13, 1962. This patent discloses a trash receptacle formed from a cylindrical hollow body member divided into mating halves by longitudinally extending joint. It has two moveable base floors, one base floor inclines and declines with opening of sections, base floor is not attached to vertical walls, container sub floor is cross spring loaded. The U.S. Pat. No. 5,901,872 has side housing door. The U.S. Pat. No. 6,234,339 B1 is a trash can with liner dispenser for storing trash can liners within lower end of side walls; a door substantially closes the cut out of the side wall, the door is hingedly coupled to side wall. The U.S. Pat. No. 4,763,809 has a skirt for off setting bottom of container; underside of bottom of container has a ratchet bar affixed' is adapted to receive a supply of liner bags, etc. The U.S. Pat. No. 4,955,497 has a cylindrical body which is bolted; an arcuate door is disposed in a cylindrical body the door comprising a substantially 180 degree arcuate section of the cylindrical body. Also it has a hinged door and is designed to have a container inside of cylindrical body. The U.S. Pat. No. 4,923,080 has a moveable base that inclines and declines, base is controlled by pedal or handle; has a pivotal door formed by side wall portion, the interior floor is the shaped of container but does not have a solid connection to it's vertical walls. The U.S. Pat. No. 4,905,853 is a divider container with arms for separation of items at it's top and with its top. The U.S. Pat. No. 5,878,904 is a apparatus for dividing a trash can into separate compartments by placing a plurality of insertable dividers from the top opening into the trash cans. The U.S. Pat. No. 5,005,727 is a dual-purpose waste receptacle, with dual division in the interior and is fill from the top as well. G. V. Carkin Patent 2,859,891 of Feb. 8, 1957 is a nursing bottle of the type involving a flask and removable container therein.

While the above mention receptacles or containers are suited for their said intended usage, none of these disclose a receptacle or container as the present invention that is split into what is to be considered the middle of itself, creating two halves, that may or may not be of exact corresponding halves, (depending on or regardless to shape or size), it include a horizontal base bottom floor that is split (normally in half), as well as it's side wall(s)being halved, with a non-moveable horizontal base bottom floor, that's halved, and with it's base bottom floor (normally half), being attached to it's halved vertical side wall(s) of the hallow body receptacle or container, with it having a lid or type of top for the purpose of sealing or closing the top opening that is at the opposite end of the horizontal halved base bottom floor and the container having a piano type hinge (may or may not be spring loaded), connecting the two said halves on either side with the opposite side of said hollow receptacle or container having a locking closure fastener system and or if hinged in center of the horizontal halved base bottom floor (may or may not have reinforced strength strips, the halved vertical side wall(s) will have the locking closure fastener system and where halves are joined may or may not have a safety strip attached to edges at it's seam(s). In as much as the prior art is relatively crowed with respect to these various types of receptacles and containers, it can be appreciated that there is a continuing need for improvements to such receptacles and containers and in this respect, the present invention addresses this. The present invention may be molded, formed or constructed of any presently known material, thus resulting in use as needed for a safety lip which can also be used as strength or reinforcing strips such as on or in the horizontal halved base bottom floor (hinged or unhinged), the hinged vertical side wall(s) as well as the opposite vertical side wall(s) which has the locking fastener closure system attached. A more detailed description of the present invention follows, in conjunction with drawings, herein:

A BRIEF DESCRIPTION OF THE DRAWINGS

Figure 3:
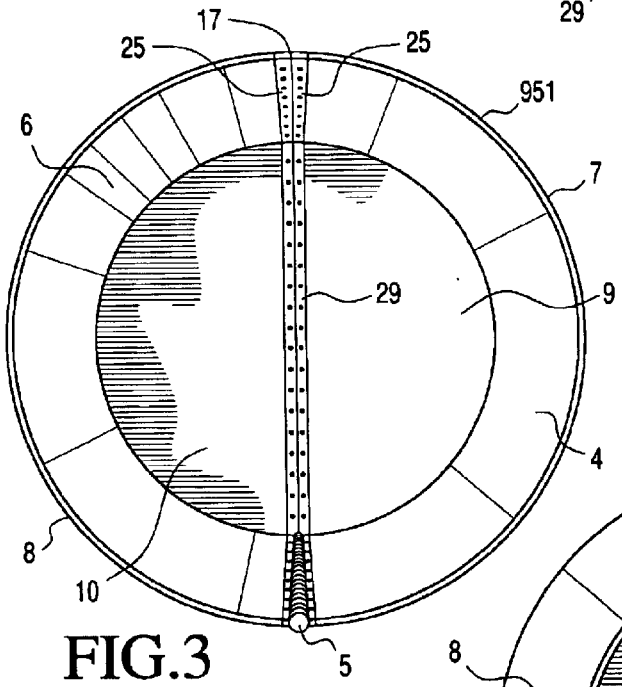
Figure 4:
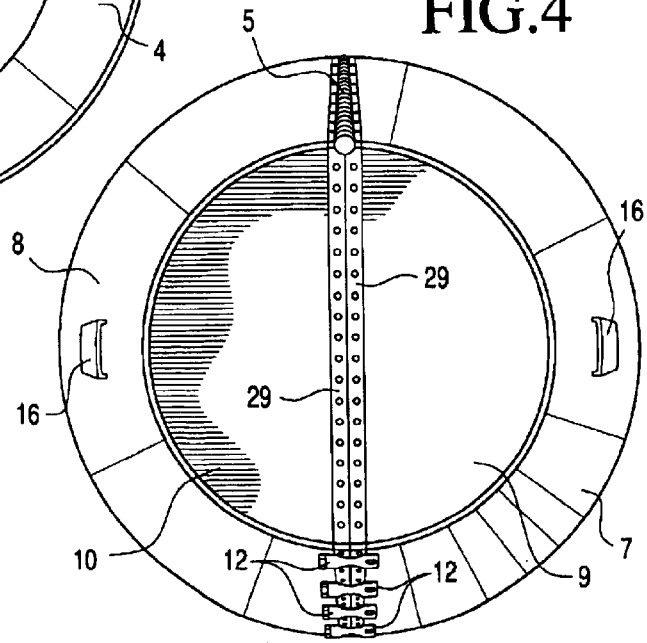
Figure 5A:
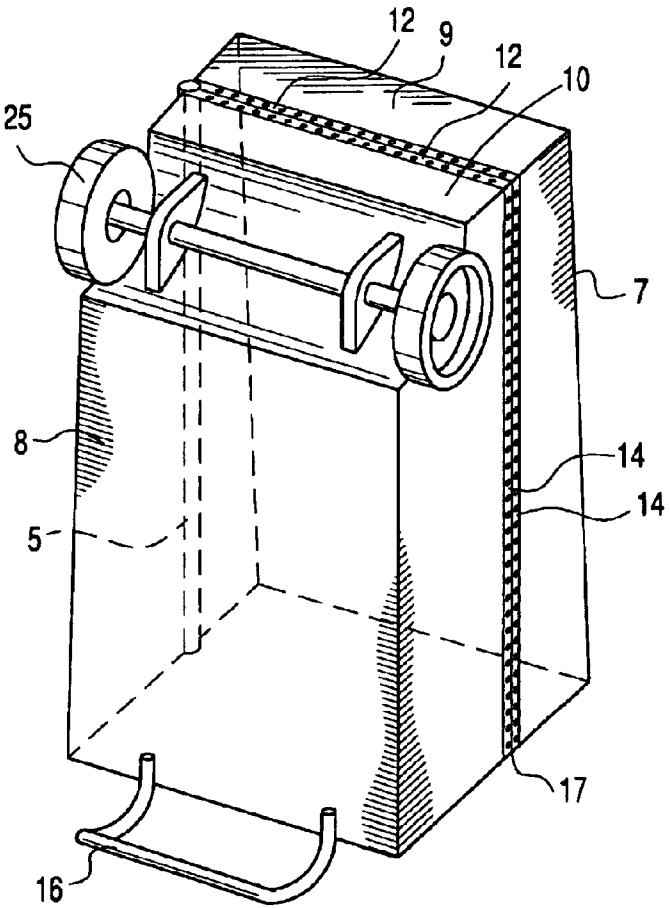
Figure 5:
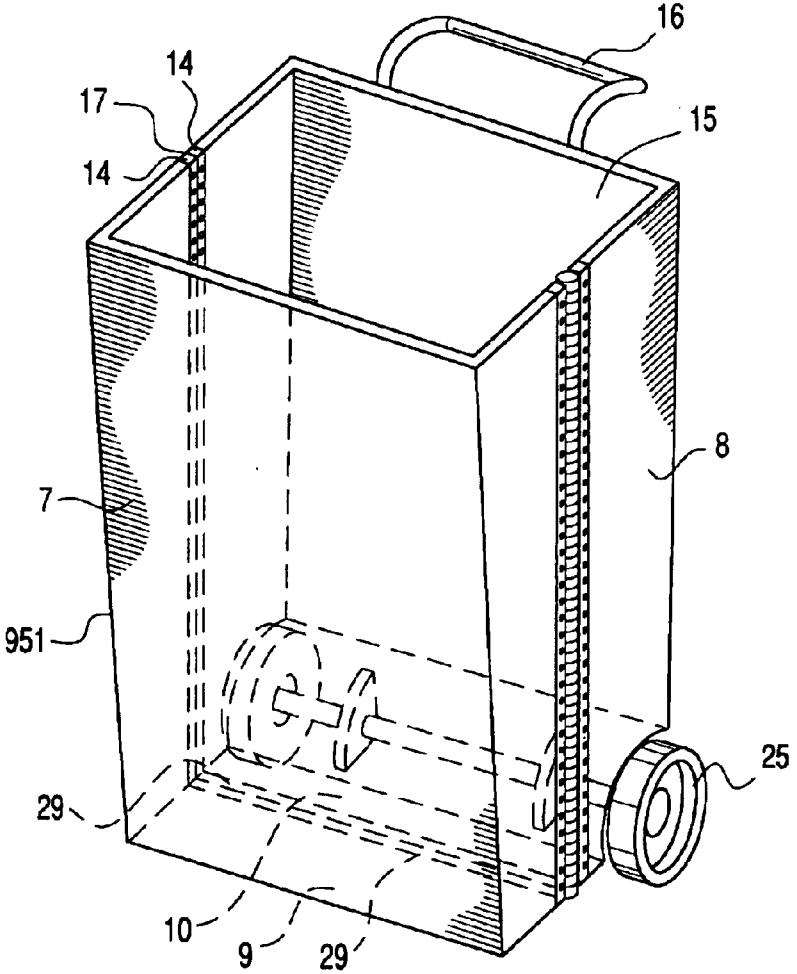
Figure 6:
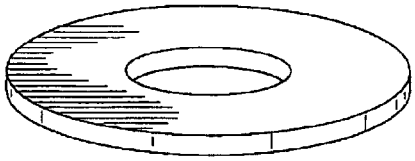
Figure 6A:
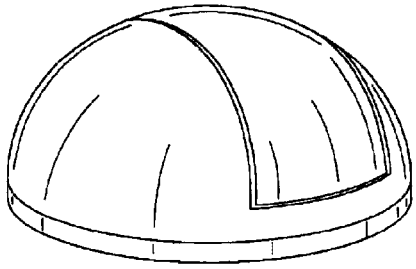
Figure 6B:
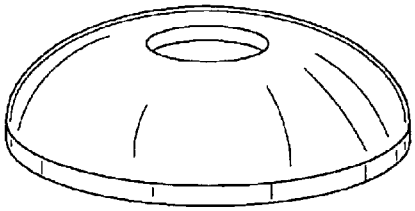
Figure 6C:
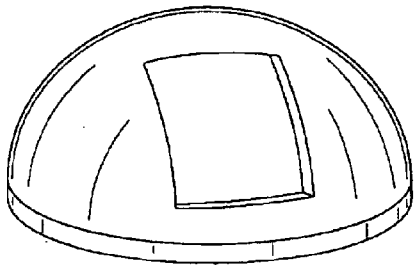
Figure 6D:
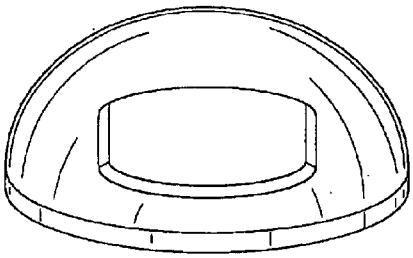
Figure 6E:
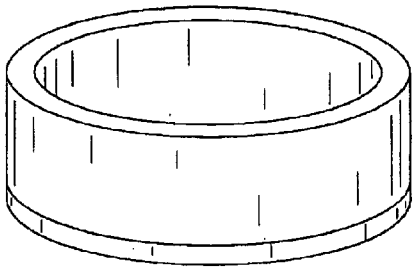
Figure 6F:
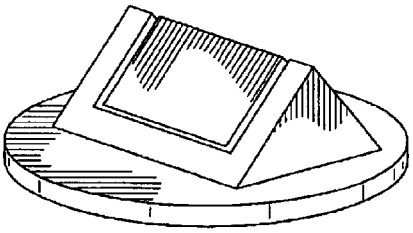
Figure 6G:
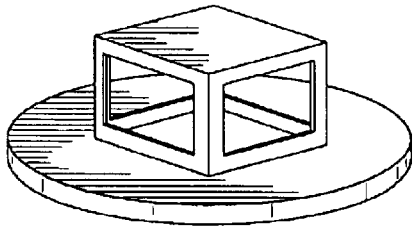
Figure 6H:
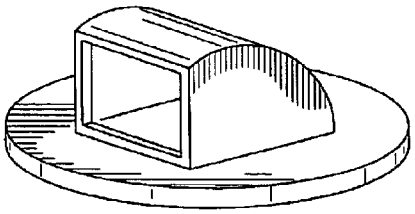
Figure 6I:
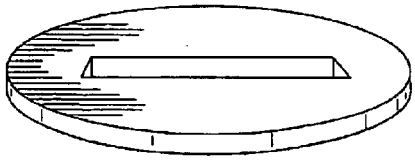
Figure 7B:
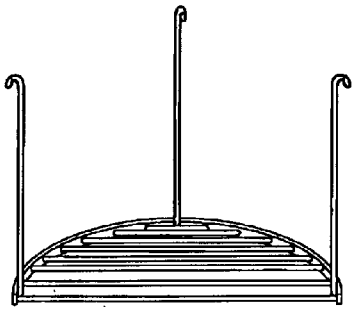
Figure 8A:
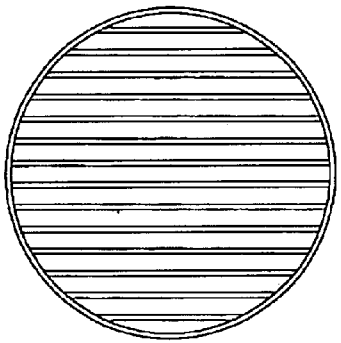
Figure 8C:
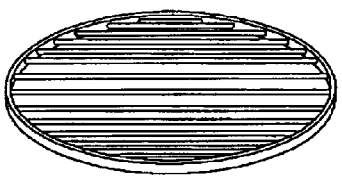
Figure 7A:
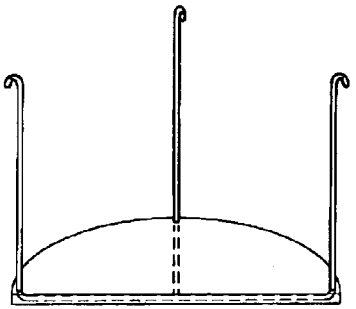
Figure 8:
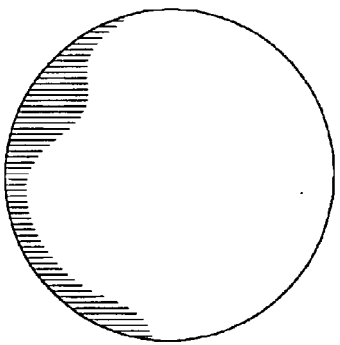
Figure 7:
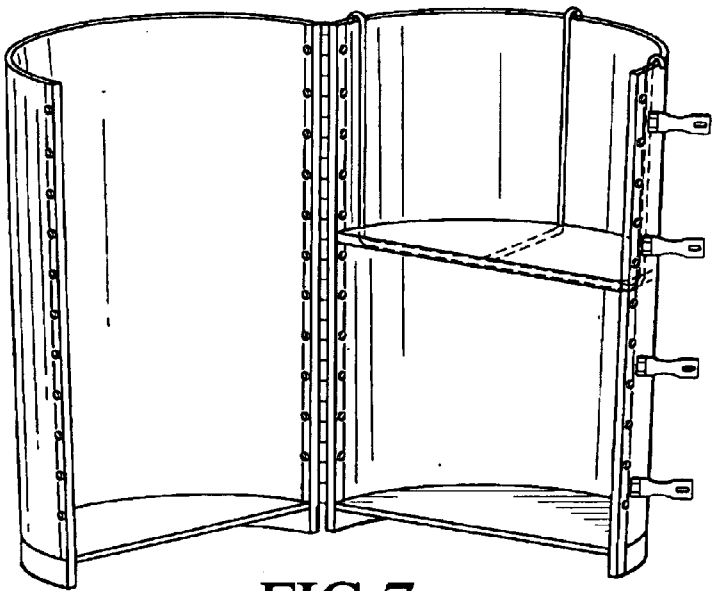

FIG. 1 is a perspective view of hinged receptacle or container according to the principles of the present invention with illustration of a Top or Lid, optional handles and it's hinged vertical side in a closed normal position and FIG. 1A is a perspective view of hinged receptacle or container according to the principles of the present invention in FIG. 1 showing top opening, featuring the piano type hinged side, the locking closure fastener system side it's handles and FIG. 1B is a perspective view of hinged receptacle or container according to the principles of the present invention in FIG. 1 showing top opening, piano type hinged side, featuring the locking closure fastener system side, it's handles and FIG. 1C is a perspective view of hinged receptacle or container according to the principles of the present invention as in FIG. 1 which is an enlarged view of a type of locking closure fastener system apparatus and FIG. 2 is a perspective view of hinged receptacle or container according to the principles of the present invention as in FIG. 1 in it's operational functional position of 0 degree to 180 degrees or greater showing it's interior vertical hollow halves with attached horizontal halved base bottom floor, it's optional safety strip, it's piano type hinged side opposite it's locking closure fastener system side, it's optional reinforcing strength strip for it's horizontal halved base bottom floor, it's vertical side wall with it's optional strength strip/ridges/grooves and FIG. 3 is a perspective view of hinged receptacle or container according to the principles of the present invention as in FIG. 1 showing a birds eye view of the interior of hinged receptacle or container illustrating it's hinged side and opposite locking closure fastener side, it's horizontal halved base bottom floor with it's reinforced strength strip and FIG. 4 is a perspective view of hinged receptacle or container according to the principles of the present invention as in FIG. 1 showing a birds eye view of the exterior of hinged receptacle or container illustrating it's hinged side and opposite locking closure fastener side, it's horizontal halved base bottom floor with it's optional reinforced strength strip and FIG. 5 is a perspective view of hinged receptacle or container according to the principles of the present invention as in FIG. 1 showing a geometric shape different from FIG. 1 and showing all of FIG. 1 amenities and apparatuses, showing it's plural hinged operational, capabilities and functionality's with it's horizontal halved base bottom floor joined with a piano type hinge with their corresponding respectively attached halved vertical hollow sides and locking closure fastener sides, however the corresponding halves are not the same shape, where as one side is provided with wheel capabilities, however the principles of the present invention of FIG. 1 with handles apply and FIG. 5A is a perspective view of hinged receptacle or container according to the principles of the present invention as shown in FIG. 5 with an inverted view with the amenities and apparatuses of FIG. 1 and FIG. 6–FIG. 6I is perspective view of hinged receptacle or container options of some types of embodiments of Tops or Lids that can be used as present invention in FIG. 1 with Top or Lid and FIG. 7 is a perspective cut away view of hinged receptacle or container of FIGS. 1, and 5 with optional embodiment 7A, (and 7B optional), that increases it's plurality and functionality, which is an optional halved shelf member to be attached by it's racks extension being placed on top opening's outer edge in a rack type procedure to that which is considered the rim of receptacle or container, (shelf member as shown can be attached to vertical side wall in other known methods or halved shelf may have support extensions from the base of the receptacle or containers {not shown}) and may be solid FIGS. 8/8B and FIGS. 8A/8C is a type of grated grill shelf member and FIG. 7A halved shelf member that is of solid consistency with rack type handle extensions FIG. 7B halved shelf member that is a grill grate member with rack type handle extensions FIGS. 8/8B is a perspective view of hinged receptacle or container embodiment for FIGS. 1, 5, 5A, 9 and 10 that increases it's plurality and functionality which is an optional bed member that is of solid consistency and is to be placed on horizontal base bottom floor when in operational closed position for additional strength purposes if desired, but is not required and FIGS. 5A/8C is a perspective views of hinged receptacle or container embodiments for FIGS. 1, 5, 5A, 9 and 10 that increases it's plurality and functionality, which is an optional grill grate bed member that can be place on the interior horizontal base bottom floor when in operational closed position for air circulation, for example storage of shelved wine bottles or drainage purposes of certain items such as plants to be transplanted, they may need drainage for a period of time, prior to easy ejection, removal or it being dislodged; FIG. 7A, FIG. 7B, FIG. 8, FIG. 8A, FIG. 8B and FIG. 8C are optional embodiments and not required for functionality nor do they interfere with it's capabilities, but should be understood they increase it's plurality, functionality and needs.

Figure 8B:
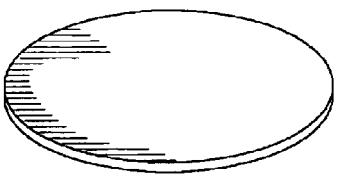
Figure 9:
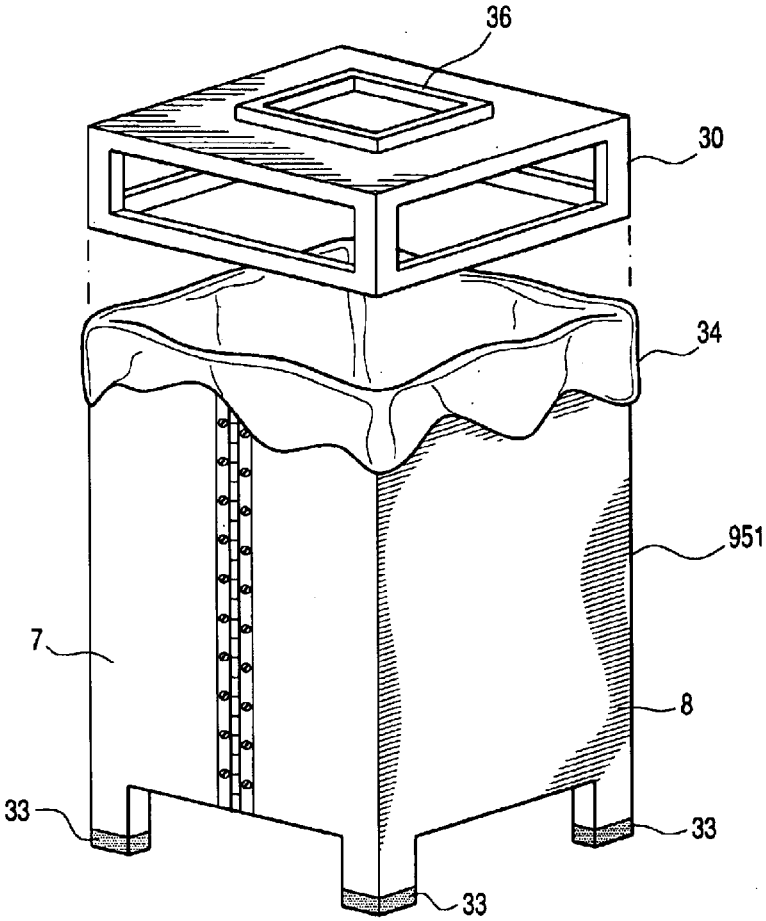
Figure 10:
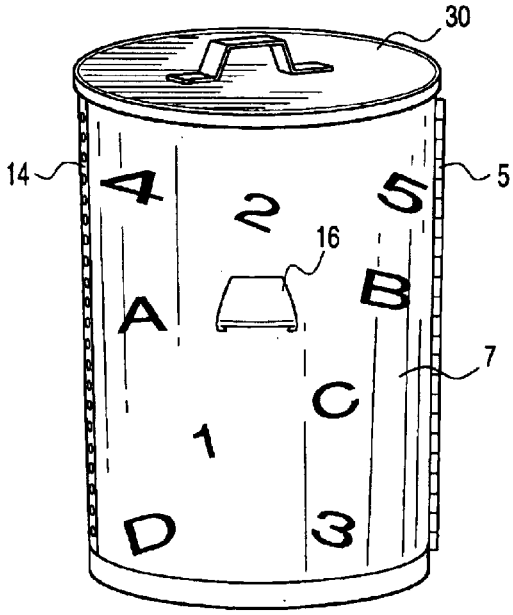

FIG. 8B is perspective angle view of hinged receptacle or container embodiment 8 that increases it's plurality and functionality, which is it's solid bed base and FIG. 8C is perspective angle view of hinged receptacle or container embodiment 8A that increases it's plurality and functionality, which is it's grate bed base and FIG. 9 is a perspective view of hinged receptacle or container with a geometric difference from FIGS. 1, 1A, 1B, 2, 3, 4, 5, 5A, and 7 with modifications from perspective view of hinged receptacle or container viewed in FIGS. 5 and 5A, which shows a wheeled version of present invention, however FIG. 9 is not a wheeled receptacle or container, but the present invention view (shown with optional rubberized floor protectors on legs and with optional ash tray capabilities), of the commercial industrial perspective, lined with known liner bag, (optionally unlined with known liner bags or optional solid insert liners), which requires the top or lid to be removed to have it's contents removed and then allows it's contents to be dislodged as stated prior for FIGS. 1, 1A, 1B, 2, 3, 4, 5 and 5A, however instead of the contents to be dislodged being up-lifted vertically over it's top edge rim after top or lid is removed which is standard with known prior art of this type, whereas the receptacle or container of present invention in shown FIG. 9 with a geometric shape difference from FIGS. 1, 1A, 1B, 2, 3, 4, 5. 5A, and 11 it has the same embodiments, pluralities, options and functionality as in FIGS. 1, 1A, 1B, 2, 3, 4, 5, 5A, and 10 is as operative and productive as FIGS. 1, 1A, 1B, 2, 3, 4, 5, 5A, 5B, and 11 and FIG. 10 is a perspective view of hinged receptacle or container of present invention (in closed position), as in FIG. 1 through FIG. 9 whereas in FIG. 9 is a perspective view of present invention commercial aspects FIG. 10 features it's educational aspects which maybe a type of applique or may be molded into structure in shape and or in form, as may it's piano type hinge and it's closure apparatus may be molded into the present invention structure in some known manner.

DETAILED DESCRIPTION OF PREFERRED EMBODIMENT

Throughout the figures of the drawings of the present hinged invention, the same parts are designated by the same reference numbers regardless of shape, view or section, however The receptacle or container 951 of the present invention as shown in FIG. 1, is in it's normal closed position showing it's hinged side 5, it's optional handles 16, a type of conventional Top or Lid 30 in which hereafter is omitted for illustration purposes only and FIG. 1A, shows the receptacle or container 951 in closed position which featuring it's piano type hinge side 5, with it's top opening 15, it's optional handles 16, it's side seam 17 and it's locked closure fastener system side 12; FIG. 1B, shows the receptacle or container 951 side featuring it's locking closure fastener system side 12, it's top opening 15, it's piano type hinge side 5, it's optional handles 16; FIG. 2 is hinged receptacle or container 951 in it's functional and operational open position of degrees from 0 degree to 180 degrees or greater, showing it's halved hollow vertical side 7 and it's attached non-moving and non-inclining or declining horizontal base floor bottom 9 and corresponding vertical side 8 and it's attached non-moving and non-inclining or declining horizontal base bottom floor 10 where as the corresponding embodiments are joined by a elongated piano type hinge 5 and it's hollow member interior 4 and 6, optional safety strip(s)14, optional horizontal base bottom reinforcing strength strip(s) 29 is shown, (optional horizontal base bottom reinforcing strength strips 29 and vertical safety strip(s) 14 may be molded into structure or mechanically attached to receptacle or container 951); FIG. 3 features a birds eye view of receptacle or container 951 interior showing it's interior hollow member 4 and 6, the interior section of it's vertical corresponding walls 7 and 8, it's halved base bottom floor 9 and 10 which has the piano type hinge 5 joining corresponding halves 9 and 10 at their center point; FIG. 4 is a perspective birds eye view of hinged receptacle or container 951 halved base bottom floor with reinforcing strength strips 29, which may be on halved base bottom floor side 9 or halved based bottom floor side 10 at the same time, thus interlocking with one another, one or both maybe interior or exterior or they may be a butting each other on either exterior or on neither, thus being necessary according to what material hinged receptacle or container 951 is made of; for example a metal receptacle or container may not need reinforcing strength strip 29, where as side wall strength bracket 27, a receptacle or container 951 of molded plastic or fiberglass may need reinforcing strips 29 and 27, as well as is true to the vertical safety strip(s) 14; molded rubber, plastic or fiberglass will not have sharp edges, thus not requiring safety strips 14, where as metal or metal type material, with razor sharp edges would probably need safety strips 14; FIG. 5 is a perspective view of the plural functionality of hinged receptacle or container 951 with same feature's as in FIGS. 1, 1A, 1B, 2, 3, 4, however, FIGS. 5, 5A, 7, 9, and 10 is to illustrate the geometric shape which is different, therefore the receptacle or container 951 will require a like Top or Lid 30 in the shape of it's opening 15, and it is understood when divided or split with above said apparatuses an amenities to create halved hinged horizontal base bottom floor, halved hinged vertical side walls with it's locking closing fastener system, the functionality is not demised when of a known physical design is used, where in the front half 23 per say may not be the same geometric shape or size as the rear half 24 which in this illustration features wheels; for example as shown, the rear or opposite half 24 is shaped to have wheels 31, unlike in other Figures except FIGS. 5, 5A, 7, 9 and 10, thus making it movable on it's wheels, and it shows that it's horizontal halved based bottom floor 9 and 10 respectively and their attached halved vertical hollow sides 7 and 8 respectively, are corresponding halves joined in same manner in every respect as stated in prior description herein and in FIG. 1 and FIGS. 5/5A, 9 and 10 is a perspective view of the plural functionality of hinged receptacle or container 951 featuring the same geometric shaped receptacle or container 951 as in FIG. 5, however, the illustration being inverted in 5A featuring a view of a type of a wheel construction 25, the halved hollow vertical side wall 23, the halved hollow vertical side wall 24, the hinged receptacle or container 951 seam(s) 17, it's handle 16, and it's perforated vertical piano type hinge side 5; FIGS. 6–6I and FIG. 7 is a cut away view of receptacle or container 951 featuring a view of present invention halved shelf embodiment attached to it's interior by it's handle extension to it's top outer rim and 7A–8C are optional embodiments and not required for functionality nor do they interfere with it's capabilities, but should be understood they are to increase it's plurality. FIGS. 7A–8C are amenities of present hinged invention, however unlike other types of prior art of sectional or compartment containers, present invention shelf member and optional horizontal bed base bottom floor options are accessible from the interior of receptacle or container 951 after it has been place into it's operational position of 0 degree to 180 degrees or greater and or through it's top opening after receptacle or container 951 is in it's closed operational position and closer fastener locking system has been secured by manufactures directions. FIG. 7 is perspective cut away view of hinged receptacle or container 951 featuring embodiment FIG. 7A, though embodiments FIGS. 8–8C and FIG. 7B are not shown herein inside of receptacle or container 951 and it should be understood that they are part of present invention to be used as is needed or desired by user. FIG. 9 is a perspective view of hinged receptacle or container of present invention with a geometric difference from FIG. 1, however it's plurality and functionally is the same as in FIG. 1–FIG. 5A, FIG. 7 and FIG. 10 and FIG. 10 is a perspective view of hinged receptacle or container of present invention in a modified form featuring all of present invention capabilities, amenities, plurality and functionally featuring it's educational value, benefits and uses with appliques which may be molded into structure as may it's type hinge/closure/wheels/handles/shelves/strength or safety apparatus and or may be attached by painting on, peel and stick, or other known means and may or may not be used in conjunction with it's shelf members for storage in areas such as in children's bedrooms, dorm rooms, family rooms and playrooms.

OPERATION

The operation of present invention: The receptacle or container 951 is best understood from examination of FIG. 1–FIG. 10. FIG. 1 shows receptacle or container 951 in it's normal closed operative position with a type of Top or Lid 30. First the user must remove the type of Top or Lid 30 (some known optional types FIG. 7–FIG. 7I), for the purpose of contents to be ejected, dislodged or removed, if lined by bag, bag should be closed according to it's manufacturer directions, (if solid liner is used follow manufacturers standard directions). FIG. 1B shows the locking fastener closure system side, in which according to type of locking fastener closure system must be appropriately disconnected by user according to it's manufacturer directions, which will allow the vertical halved hollow sides 4/7 and 6/8 respectively with their attached horizontal base bottom halved floor 9 and 10 respectively to rotate on it's piano type hinged side 5 as seen in FIG. 1A, whereas it's piano type hinge 5 provides the said vertical halves to rotate and be separated by user, when user separates vertical halves 7 and 8 respectively with horizontal base bottom halves 9 and 10 respectively by pulling them in opposite directions outwardly to achieve the position as shown in FIG. 2. FIG. 2 is where said vertical side halves 7 and 8 respectively with their horizontal attached halved base bottom floor 9 and 10 respectively are at 0 degree to 180 degrees or greater, where contents can be voluntarily be removed, ejected or dislodged by user, whether assisted or unassisted by users, with a hands on liner(s), bagged or not bagged. As seen in FIG. 2, when receptacle or container 951 vertical hollow side halves 7 and 8 respectively reach or exceed a degree of 180 degrees or greater, the prior center of the horizontal base bottom floor expires, thus it becomes bottomless at that point and from that point, therefore the receptacle or container 951 contents is automatically ejected, dislodged and or is removed from the receptacle of container 951. The pivotal movement allowed by it's piano type hinge 5 of either one or both of it's halved vertical sides 7 and 8 respectively with their attached horizontal halved base bottom floor 9 and 10, provides receptacle or container 951 it operational open access. When receptacle or container 951 is in it's operational open access position as shown in FIG. 2, the user has an unrestricted, unencumbered and an enlarged area for the emptying, dislodging and removal and or the automatic ejection. After receptacle or container 951 contents are removed by user's choice of method, whether by shifting receptacle or container 951 from side to side, slightly pulling contents out by side movement of bagged or lined contents after it is sealed or if contents are automatically ejected because of present invention capabilities, the vertical halved sides 7 and 8 respectively with their attached horizontal base bottom floor 9 and 10 respectively will then be returned assisted or unassisted by spring piano type hinge or by user pulling together vertical side 7 and 8 to closed operational position as seen in FIG. 1, and as seen in FIG. 1B, it's locking fasteners closure side system 12 can be re-locked as in accordance to required means. If receptacle or container 951 is to be lined, for example as with known bag liners, it can be done at this point according to such necessary instructions that are required by it's manufacturer. FIG. 5 and 5A shows the present invention of FIG. 1 in a different geometric shape with the aspects in which the removal or dislodged contents are not controlled by an interior priority floor that inclines or declines with vertical side wall movement that's above the receptacle or container floor, but is to have it's contents removed by previously stated method of sliding bag liner to either side of the enlarged/open area and the different geometric shape as previously shown. FIG. 6–FIG. 6I are known top/Lids 30. FIG. 9 and FIG. 10 has the exact same amenities, functionality's, plurality, removal and dislodging methods of contents as present invention shape as seen in FIG. 1 through FIG. 4 as well as FIGS. 5 and 5A.

The principles and preferred embodiments of the present invention have been described in the foregoing specifications. However, the inventions should not be construed as being limited to the particular embodiment, materials or apparatus described herein. Instead the embodiments described herein should be regarded as illustrative and not restrictive. The present invention is defined by the following claims.

We claim:

1. A trash receptacle comprising a pair of vertically extending side walls, each side wall having a top edge portion, and a pair of vertically extending edges, the pair of vertically extending edges on one side wall abutting the corresponding pair of vertically extending edges on the other side wall to thereby provide an enclosed receptacle, a trash bag mounted in said receptacle, the top edge portion of the bag folded over the top edge portion of each side wall, hinge means connected between one of the vertically extending edges on one side wall and a vertically extending edge of the other side wall, whereby the side walls can be pivoted from the enclosed position to an open position, a floor portion connected to the bottom edge portion of each side wall, to thereby provide a floor for supporting said trash bag in the receptacle while in the enclosed position, and reinforcing members being provided on said side walls and said floor portions, whereby when the side walls are moved to the open position, the floor portions move outwardly from under the trash bag, to thereby deposit the trash bag on the ground.

2. A trash receptacle according to claim 1, wherein releasable locking fastener means are connected between the other vertically extending edge of said one side wall and the other vertically extending edge of said one side wall and the other vertically extending side wall of said other side wall for holding the side walls in the enclosed position.

3. A trash receptacle according to claim 1, wherein the hinge means comprises a piano hinge.

4. A trash receptacle according to claim 1, wherein the hinge means is provided with a spring for biasing the side walls to the open position.

5. A trash receptacle according to claim 1, wherein a removable closure is positioned on the top edges of the pair of side walls.

6. A trash receptacle according to claim 5, wherein handles are mounted on the side walls.

7. A trash receptacle according to claim 1, wherein a removable shelf is mounted in the receptacle above the floor.

8. A trash receptacle according to claim 1, wherein educational indicia is applied to the exterior surface of each side wall.

9. A trash receptacle comprising a pair of vertically extending side walls, each side wall having a top edge portion and a pair of vertically extending edges, the pair of vertically extending edges on one side wall abutting the corresponding pair of vertically extending edges on the other side wall to thereby provide an enclosed receptacle, a trash bag mounted in said receptacle, the top edge portion of the bag folded over the top edge portion of each said wall, hinge means connected between one of the vertically extending edges on one side wall and a vertically extending edges of the other side wall, whereby the side walls can be pivoted from the enclosed position to an open position, a floor portion connected to the bottom edge portion of each side wall to thereby provide a floor for supporting trash in the receptacle while in the enclosed position and a removable shelf mounted in the receptacle above said floor, whereby when the side walls are moved to the open position, the floor portions move outwardly from under the trash, to thereby deposit the trash on the ground.

* * * * *